US010707606B2

(12) United States Patent
Ho

(10) Patent No.: US 10,707,606 B2
(45) Date of Patent: Jul. 7, 2020

(54) ELECTRICAL CONNECTOR

(71) Applicant: LOTES CO., LTD, Keelung (TW)

(72) Inventor: Chien Chih Ho, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/351,919

(22) Filed: Mar. 13, 2019

(65) Prior Publication Data

US 2019/0288430 A1 Sep. 19, 2019

Related U.S. Application Data

(60) Provisional application No. 62/642,751, filed on Mar. 14, 2018.

(30) Foreign Application Priority Data

Dec. 10, 2018 (CN) ..... 2018 1 1501074

(51) Int. Cl.
*H01R 13/24* (2006.01)
*H01R 12/71* (2011.01)
(Continued)

(52) U.S. Cl.
CPC ..... *H01R 13/2435* (2013.01); *H01R 12/712* (2013.01); *H01R 13/08* (2013.01);
(Continued)

(58) Field of Classification Search
CPC .. H01R 12/712; H01R 13/08; H01R 13/2435; H01R 13/15; H01R 13/24; H01R 13/41; H01R 13/64; H01R 13/73
See application file for complete search history.

(56) References Cited

U.S. PATENT DOCUMENTS 4,655,519 A * 4/1987 Evans ..... H05K 7/1069 439/514
5,324,205 A * 6/1994 Ahmad ..... H01R 12/714 439/66

(Continued)

FOREIGN PATENT DOCUMENTS

CN 2884574 Y 3/2007
CN 201266710 Y 7/2009

(Continued)

*Primary Examiner* — Briggitte R. Hammond
(74) *Attorney, Agent, or Firm* — Locke Lord LLP; Tim Tingkang Xia, Esq.

(57) ABSTRACT

An electrical connector includes an insulating body. At least one accommodating hole runs through the insulating body vertically, and each accommodating hole has a stopping portion and a position limiting portion. Each accommodating hole accommodates a terminal and an electrical conductor. The terminal is in contact with the electrical conductor. The terminal upward abuts the stopping portion. The terminal is connected to a first strip downward, and is mounted into the accommodating hole upward from bottom. The electrical conductor upward abuts the position limiting portion. The electrical conductor is connected to a second strip downward, and is mounted into the accommodating hole upward from bottom. The terminal upward abuts the stopping portion and thus does not excessively move upward, and the electrical conductor upward abuts the position limiting portion and thus does not excessively move upward.

20 Claims, 5 Drawing Sheets

(51) Int. Cl.

| | |
|---|---|
| ***H01R 13/41*** | (2006.01) |
| ***H01R 13/08*** | (2006.01) |
| ***H01R 13/15*** | (2006.01) |
| ***H01R 13/64*** | (2006.01) |
| ***H01R 13/73*** | (2006.01) |

(52) U.S. Cl.
CPC ..... *H01R 13/15* (2013.01); *H01R 13/24* (2013.01); *H01R 13/41* (2013.01); *H01R 13/64* (2013.01); *H01R 13/73* (2013.01)

(56) References Cited

U.S. PATENT DOCUMENTS 5,380,210 A * 1/1995 Grabbe ..... H01R 13/2435 439/66
6,155,845 A * 12/2000 Lin ..... H01R 4/028 439/78
6,875,025 B2 * 4/2005 Hsu ..... H01R 13/112 439/140
7,001,190 B2 * 2/2006 Morana ..... H01R 13/112 439/81
7,128,622 B2 * 10/2006 Tsai ..... H05K 3/3426 439/874
7,182,605 B2 * 2/2007 Sun ..... H05K 7/1069 439/66
7,201,584 B1 * 4/2007 Ju ..... H01R 13/2407 439/66
7,497,744 B2 * 3/2009 Tsai ..... H01R 12/57 439/331
7,553,202 B2 * 6/2009 Ma ..... H01R 12/57 439/839
7,635,269 B2 * 12/2009 Oda ..... H01R 13/2421 439/71
7,695,286 B2 * 4/2010 Swart ..... H01R 12/714 439/66
7,862,343 B1 * 1/2011 Lin ..... H01R 13/2421 439/66
7,938,649 B2 * 5/2011 Gattuso ..... H01R 13/115 439/71
8,535,093 B1 * 9/2013 Mason ..... H01R 13/6585 439/607.05
8,814,603 B2 * 8/2014 Chang ..... H01R 24/00 439/626
8,888,502 B2 * 11/2014 Terhune, IV ..... H01R 13/2407 439/66
8,932,080 B2 * 1/2015 Chang ..... H05K 7/1069 439/607.1
9,033,737 B2 * 5/2015 Chang ..... H01R 13/6588 439/607.05
2010/0029102 A1 * 2/2010 Chen ..... H01R 13/17 439/66

FOREIGN PATENT DOCUMENTS

CN 101212095 B 1/2012
CN 206947575 U 1/2018

* cited by examiner

10

ELECTRICAL CONNECTOR

CROSS-REFERENCE TO RELATED PATENT APPLICATION

This non-provisional application claims priority to and the benefit of, pursuant to 35 U.S.C. § 119(e), U.S. provisional patent application Ser. No. 62/642,751 filed Mar. 14, 2018, and under 35 U.S.C. § 119(a), patent application Serial No. CN201811501074.8 filed in China on Dec. 10, 2018. The disclosures of the above applications are incorporated herein in their entireties by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and more particularly to an electrical connector in which terminals are conveniently and stably mounted in an insulating body.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Nowadays, electrical connectors have been used in various fields of life. With the development of science and technology, the demand for electrical connectors is increasing, and the requirement for the stability of signal transmission of electrical connectors is also gradually improved. Thus, it is increasingly important to ensure the stability of signal transmission of electrical connectors.

An existing electrical connector is mounted to a circuit board. The electrical connector includes an insulating body, where multiple accommodating holes run through the upper and lower surfaces of the insulating body. Multiple terminals are connected to a first strip upward. Multiple electrical conductors are connected to a second strip upward. The terminals are respectively mounted into the accommodating holes downward from top, and the electrical conductors are respectively mounted into the accommodating holes downward from top. Each of the accommodating holes accommodates a terminal and an electrical conductor. Each of the accommodating holes is provided with a position limiting portion for limiting the terminal from moving downward excessively, and a protruding block for limiting the electrical conductor from moving downward excessively. After the terminals and the electrical conductors are respectively mounted at the predetermined positions of the accommodating holes, the first strip and the second strip are removed to form the electrical connector.

When the electrical connector is mounted and soldered to the circuit board, the terminals and the electrical conductors are soldered to the circuit board via a solder and simultaneously downward abut the circuit board. Since no structure is provided in the accommodating holes to limit the terminals and the electrical conductors from moving upward, the circuit board generates an upward resisting force toward the terminals and the electrical conductors, and the terminals and the electrical conductors move upward. Thus, both the terminals and the electrical conductors cannot be accurately positioned on the circuit board, and the molten solder cannot sufficiently flow back to the soldered sections of the terminals and the soldered sections of the electrical conductors, such that both the terminals and the electrical conductors are not stably soldered to the circuit board. In an extreme case, the terminals and the electrical conductors may be both detached from the circuit board, causing the phenomena of empty soldering and missing soldering.

Therefore, a heretofore unaddressed need to design a new electrical connector exists in the art to address the aforementioned deficiencies and inadequacies.

SUMMARY

In view of the above deficiencies, the present invention is directed to an electrical connector, in which a terminal and an electrical conductor in the same accommodating hole are both connected downward to strips, such that the terminal and the electrical conductor can be stably fixed to an insulating body and reliably mounted on a circuit board to ensure the stability of signal transmission.

To achieve the foregoing objective, the present invention adopts the following technical solutions.

An electrical connector includes an insulating body, wherein at least one accommodating hole runs through the insulating body vertically, and each of the at least one accommodating hole has a stopping portion and a position limiting portion; wherein each of the at least one accommodating hole accommodates a terminal and an electrical conductor, and the terminal is in contact with the electrical conductor; wherein the terminal upward abuts the stopping portion, and the terminal is configured to be connected to a first strip downward and is mounted into the accommodating hole upward from bottom; and wherein the electrical conductor upward abuts the position limiting portion, and the electrical conductor is configured to be connected to a second strip downward and is mounted into the accommodating hole upward from bottom.

In certain embodiments, the terminal is provided with at least one first strip connecting portion connected to the first strip, and an orthogonal projection of the stopping portion downward from top partially overlaps with a projection of the first strip connecting portion.

In certain embodiments, the accommodating hole is further provided with a stopping block, the terminal has a base accommodated in the accommodating hole, the base bends and extends to form a blocking portion, and the blocking portion upward abuts the stopping block.

In certain embodiments, the terminal has a first elastic arm extending upward and a second elastic arm extending downward, the first elastic arm is in contact with a mating component, at least one first abutting portion extends from the first elastic arm toward the electrical conductor, the first abutting portion is in contact with the electrical conductor, at least one second abutting portion extends from the second elastic arm to the electrical conductor, and the second abutting portion is in contact with the electrical conductor.

In certain embodiments, the first elastic arm has a first contact portion; before the mating component presses the first contact portion, the first abutting portion and the electrical conductor in contact with each other have a first contact position; and after the mating component presses the first contact portion, the first abutting portion and the electrical conductor in contact with each other have a second contact position.

In certain embodiments, the electrical conductor has a main body portion, an extending portion extends from the main body portion, the first abutting portion and the second abutting portion are in contact with the extending portion, and the main body portion is configured to be soldered to a circuit board.

In certain embodiments, the extending portion has a second strip connecting portion connected to the second strip, and the second strip connecting portion is located above the main body portion.

In certain embodiments, the second elastic arm is in contact with the main body portion; before the circuit board upward abuts the main body portion, the second abutting portion and the extending portion in contact with each other have a third contact position; and after the circuit board upward abuts the main body portion, the second abutting portion and the extending portion in contact with each other have a fourth contact position.

In certain embodiments, the first elastic arm has two first contact portions, a first slot is provided between the two first contact portions, the two first contact portions are both in contact with the mating component, the second elastic arm has two second contact portions, and a second slot is provided between the two second contact portions.

In certain embodiments, the first slot runs through a plate thickness of the first elastic arm and extends to the first abutting portion, and the second slot runs through a plate thickness of the second elastic arm and extends to the second abutting portion.

In certain embodiments, the terminal is provided with at least one first strip connecting portion connected to the first strip, the second elastic arm has a second contact portion, and the second contact portion is lower than the first strip connecting portion.

In certain embodiments, the electrical conductor is protrudingly provided with a protruding portion and a resisting portion, the position limiting portion upward abuts the resisting portion, and the position limiting portion downward abuts the protruding portion.

To achieve the foregoing objective, the present invention adopts the following technical solutions.

An electrical connector includes an insulating body, wherein at least one accommodating hole runs through the insulating body vertically; wherein each of the at least one accommodating hole accommodates a terminal and an electrical conductor, and the terminal is in contact with the electrical conductor; wherein the terminal is configured to be electrically connected to a mating component, and is configured to be connected to a first strip downward and is mounted into the accommodating hole upward from bottom; and wherein the electrical conductor is configured to be conductively connected to a circuit board, and is configured to be connected to a second strip downward and is mounted into the accommodating hole upward from bottom.

In certain embodiments, the accommodating hole is provided with a stopping portion and a position limiting portion, the stopping portion stops the terminal downward, and the position limiting portion stops the electrical conductor downward.

In certain embodiments, the terminal has a base accommodated in the accommodating hole, a first elastic arm extends upward from the base, the first elastic arm has at least one contact portion conductively connected to the mating component, a first abutting portion extends downward from each of the at least one contact portion, a second elastic arm extends downward from the base, the second elastic arm has a second contact portion in contact with the electrical conductor, and a second abutting portion extends upward from the second contact portion; each electrical conductor has a main body portion, the main body portion is electrically connected to the circuit board, the main body portion is in contact with the second contact portion, an extending portion extends from the main body portion, and the first abutting portion and the second abutting portion are in contact with the extending portion.

In certain embodiments, the accommodating hole is protrudingly provided with a stopping block, the first elastic arm has a blocking portion, and the stopping block abuts the blocking portion to limit the terminal from moving downward.

Compared with the related art, the electrical connector according to certain embodiments of the present invention has the beneficial effects:

The accommodating hole has the stopping portion and the position limiting portion. The base is connected to the first strip downward, and the electrical conductor is connected to the second strip downward, such that the terminal and the electrical conductor are both mounted into the accommodating hole upward from bottom. The base upward abuts the stopping portion upward and thus does not excessively move upward, and the electrical conductor upward abuts the position limiting portion and thus does not excessively move upward, thereby ensuring that the terminal and the electrical conductor are accurately positioned on the insulating body and the circuit board. During soldering, the solder sufficiently flows back to the soldering section of the terminal and the soldering section of the electrical conductor to ensure that both the terminal and the electrical conductor are stably soldered to the circuit board, thereby avoiding the phenomena of empty soldering and missing soldering and further ensuring the stability of signal transmission.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
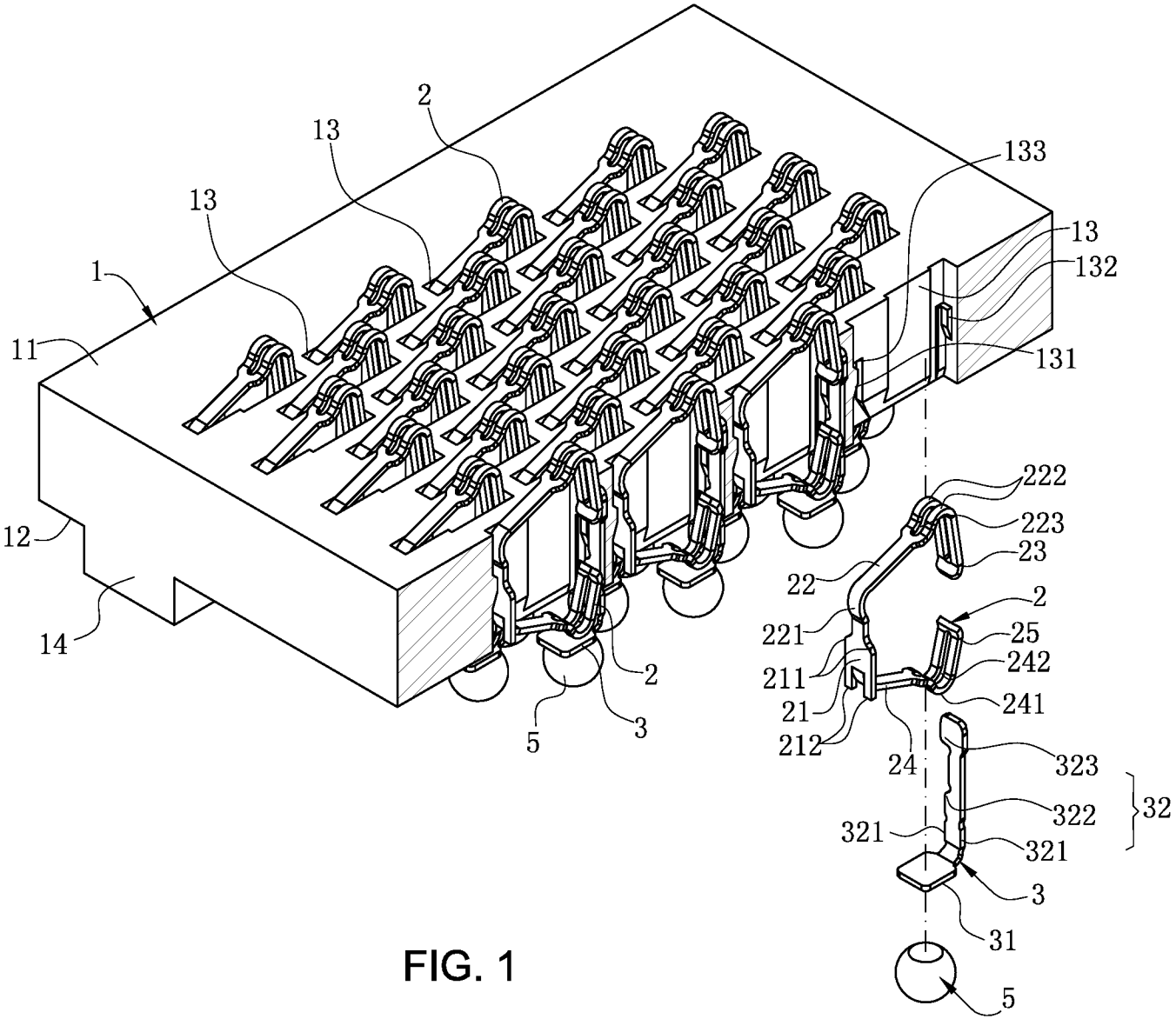
FIG. 1 is a perspective sectional view of an electrical connector according to certain embodiments of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-5. In accordance with the purposes of this invention, as embodied and broadly described herein, this invention, in one aspect, relates to an electrical connector.

Figure 3:
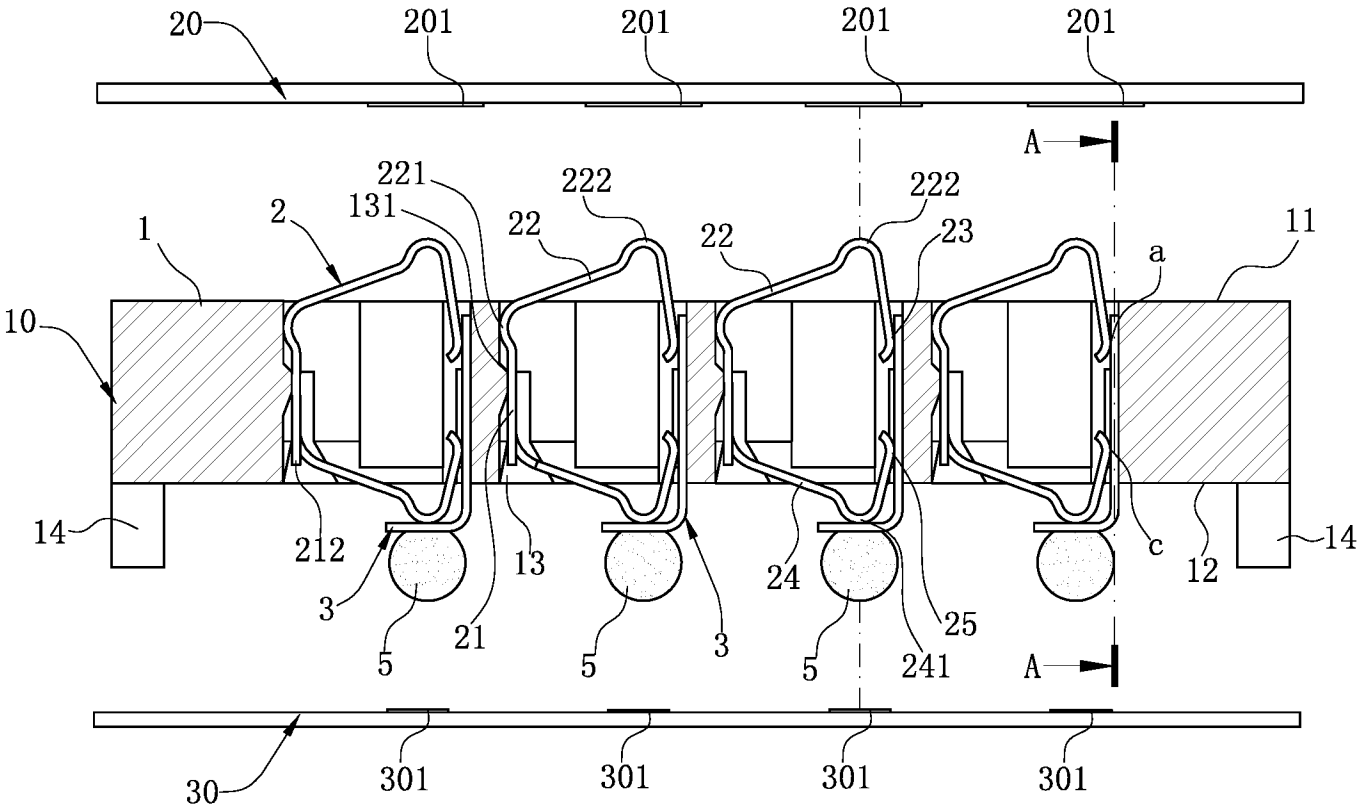
FIG. 3 is a front view of the electrical connector of FIG. 1 before a chip module is pressed downward.

Referring to FIG. 1 and FIG. 3, an electrical connector 10 according to certain embodiments of the present invention is used to mate with a mating component 20 and is connected to a circuit board 30. The mating component 20 has a plurality of pads 201 thereon, the circuit board 30 has a plurality of conducting sheets 301 thereon, and the pads 201 and the conducting sheets 301 are both electrically connected to the electrical connector 10. The electrical connector 10 has an insulating body 1 in a lengthwise direction, and a plurality of terminals 2 and a plurality of electrical conductors 3 are provided on the insulating body 1 to be electrically connected to the mating component 20 and the circuit board 30 respectively.

Figure 2:
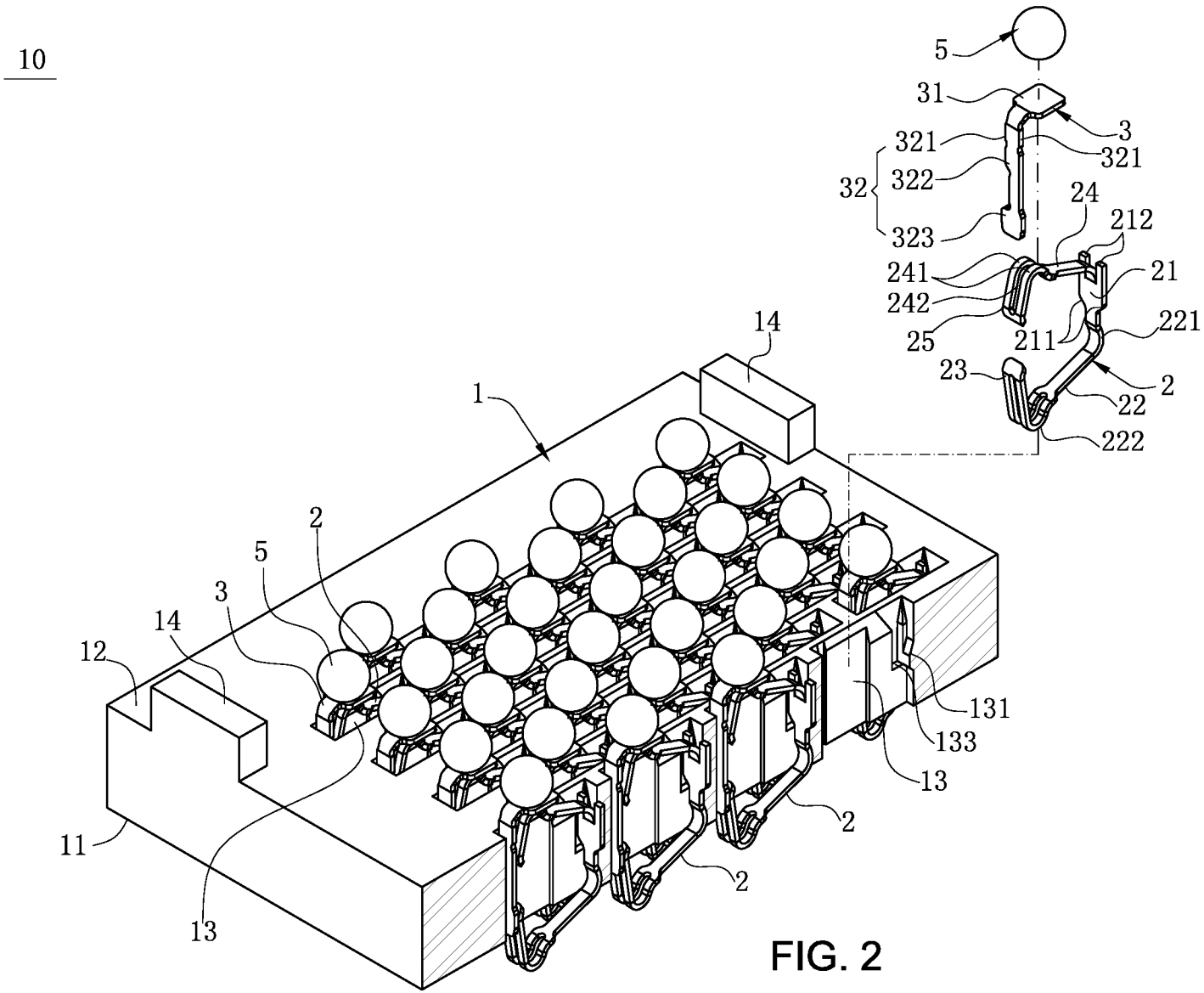
FIG. 2 is a schematic view of the electrical connector of FIG. 1 being 180° inverted.

Referring to FIG. 1 and FIG. 2, the insulating body 1 has an upper surface 11 and a lower surface 12. A plurality of accommodating holes 13 run through the upper surface 11 and the lower surface 12 of the insulating body 1. A stopping block 131 and a position limiting portion 132 protrude from the inner wall of each of the accommodating holes 13. A stopping portion 133 is concavely provided on from the inner wall of each of two sides of the accommodating hole 13. The position limiting portion 132 is used for limiting the electrical conductor 3 from moving, and the stopping block 131 and the stopping portion 133 are used for limiting the position of the terminal 2. A plurality of supporting posts 14 are protrudingly provided on the lower surface 12 to support the electrical connector 10 onto the circuit board 30.

Referring to FIG. 1, the terminals 2 and the electrical conductors 3 are correspondingly accommodated in the accommodating holes 13. Each accommodating hole 13 accommodates one terminal 2 and one electrical conductor 3. In the present embodiment, the electrical conductors 3 are preferably made of a metal material, and can also be made of other non-metal conductive material such as conductive plastics.

Referring to FIG. 1 and FIG. 3, each terminal 2 has a base 21 accommodated in the corresponding accommodating hole 13, and a side portion 211 protrudes from each of two sides of the base 21. When the terminal 2 is accommodated in the accommodating hole 13, the stopping portion 133 stops the side portion 211 downward to limit the terminal 2 from moving upward. The base 21 bends upward and extends to form a first elastic arm 22 exposing from the insulating body 1. The first elastic arm 22 forms a blocking portion 221 at the bending position to abut the stopping block 131. The position where the blocking portion 221 abuts the stopping block 131 is a bending and rotating pivot point of the first elastic arm 22, and the pivot point provides a supporting force for the first elastic arm 22 to support the rotation of the first elastic arm 22. The first elastic arm 22 bends to form two first contact portions 222, and the two first contact portions 222 simultaneously upward abut the pads 201 upward. Such design structure increases the paths for transmitting electrical signals to the terminal 2 and ensures the stability of the mating component 20 in contact with the terminal 2. A first abutting portion 23 extends downward from each of the two first contact portions 222 to be in contact with the electrical conductor 3. The free ends of the two first abutting portions 23 are connected to each other. A first slot 223 is provided between the two first contact portions 222, and the first slot 223 extends from the first contact portions 222 to the first abutting portions 23. The first slot 223 runs through the plate thickness of the first elastic arm 22. The first slot 223 reduces the hardness of the first elastic arm 22, but increases the elasticity of the first elastic arm 22, thereby generating a larger elastic force enabling the first abutting portions 23 to abut the electrical conductor 3.

Figure 4:
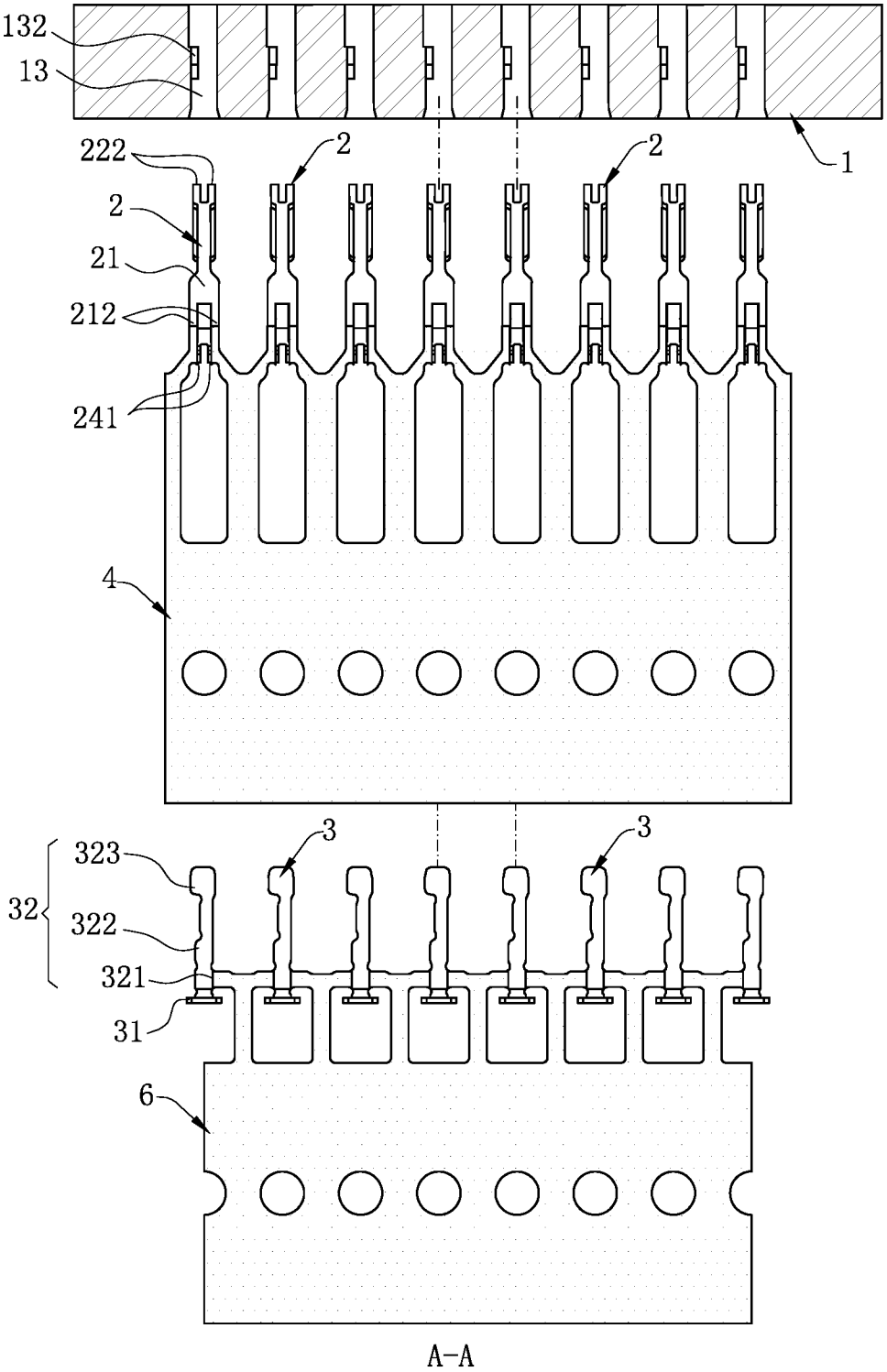
FIG. 4 is a sectional view of the electrical connector and strips of FIG. 3 in an A-A direction.

Referring to FIG. 1, FIG. 3 and FIG. 4, two first strip connecting portions 212 extend from a lower end of the base 21, and the first strip connecting portions 212 are connected to a first strip 4. An orthographic projection of the stopping portion 133 downward from top partially overlaps with the projection of the first strip connecting portions 212, thereby ensuring that the width of the accommodating hole 13 does not increase while the terminal 2 is fixed. A second elastic arm 24 extends downward from the base 21. An end of the second elastic arm 24 bends to form two second contact portions 241 in contact with the electrical conductor 3, and the second contact portions 241 are lower than the first strip connecting portions 212. Since the second elastic arm 24 is elastic, the second contact portions 241 compress and abut the electrical conductor 3. When the second contact portions 241 are lower than the first strip connecting portions 212, an arm of force of the second elastic arm 24 can be increased to increase the elasticity, thereby increasing the abutting force between the second contact portions 241 and the electrical conductor 3. A second abutting portion 25 extends upward from each of the two second contact portions 241 to be in contact with the electrical conductor 3. The free ends of the two second abutting portions 25 are connected to each other. A second slot 242 is provided between the two second contact portions 241, and the second slot 242 extends from the second contact portions 241 to the second abutting portions 25. The second slot 242 also runs through the plate thickness of the second elastic arm 24 to increase the elasticity of the second elastic arm 24, thereby generating a larger elastic force enabling the second abutting portions 25 to urge the electrical conductor 3.

Referring to FIG. 1, FIG. 3 and FIG. 4, each electrical conductor 3 has a main body portion 31. The main body portion 31 is flat plate shaped, and is upward in contact with the two second contact portions 241 and soldered to the conducting sheet 301 via a solder 5. Since the second contact portions 241 are elastic structures, if the second contact portions 241 are directly soldered to the circuit board 30, the elastic force borne by the second contact portions 241 inevitably causes the second contact portions 241 to slip on the circuit board 30, causing the solder 5 to fall off and resulting in poor contact. Thus, the contact between the main body portion 31 and the circuit board 30 achieves the purpose of electrical conduction and ensures that the second contact portions 241 are still elastic. In other embodiments, the main body portion 31 can also be electrically connected to the conducting sheet 301 by surface adhesion technology. An extending portion 32 extends vertically upward from a side of the main body portion 31, and the first abutting portions 23 and the second abutting portions 25 simultaneously abut the plate surface of the extending portion 32, thereby increasing the paths of signal transmission and ensuring the stability of signal transmission. The extending portion 32 includes a second strip connecting portion 321, a protruding portion 322 and a resisting portion 323 sequentially from bottom to top. A second strip 6 is connected to a side of the second strip connecting portion 321. Since the main body portion 31 is located below the second strip connecting portion 321, when the electrical conductor 3 is mounted from bottom to top, the width of the accommodating hole 13 does not need to increase for the main body portion 31. The protruding portion 322 and the resisting portion 323 protrude from the side of the extending portion 32. The position limiting portion 132 upward abuts the resisting portion 323, and downward abuts the protruding portion 322 to limit the position of the electrical conductor 3.

Figure 5:
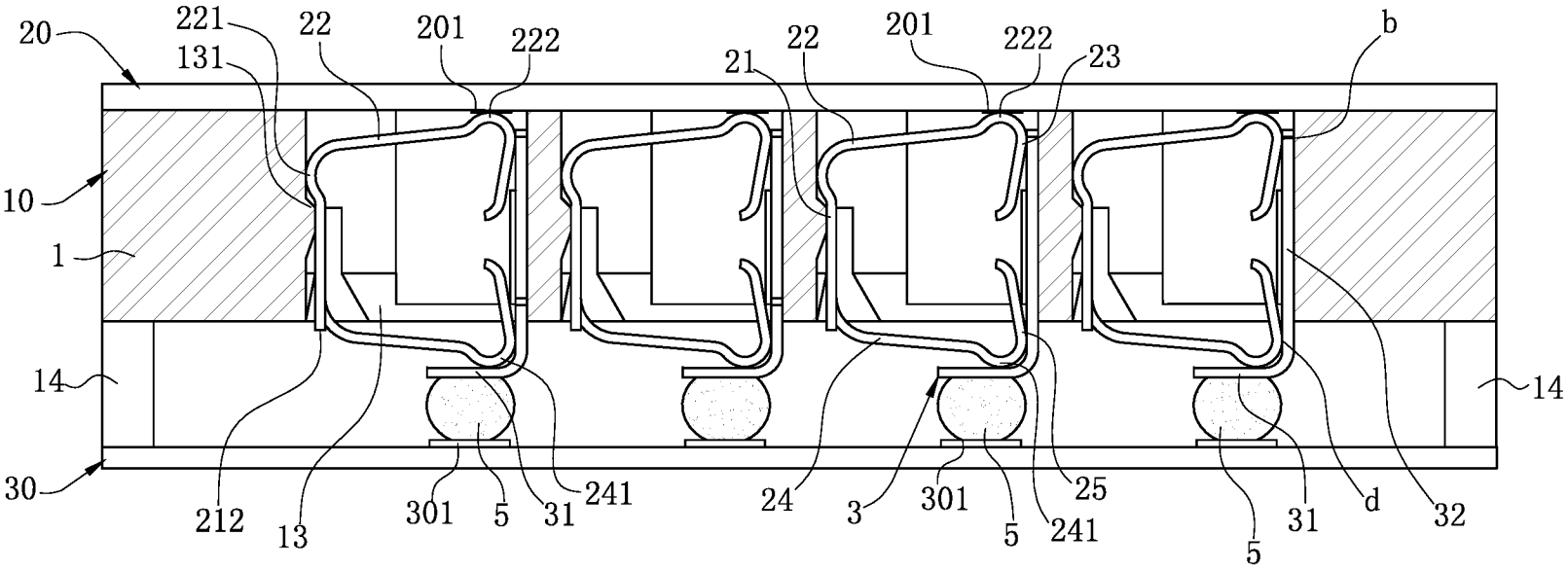
FIG. 5 is a front view of the electrical connector of FIG. 1 after the chip module is pressed downward.

Referring to FIG. 3, FIG. 4 and FIG. 5, the first strip 4 is connected to the terminal 2 and mounted into the accommodating hole 13 upward from bottom. The stopping portion 133 stops the side portions 211 to limit the terminal 2 from moving upward, and the stopping block 131 abuts the blocking portion 221 such that the first elastic arm 22 is deformed. When the blocking portion 221 passes beyond the stopping block 131, the stopping block 131 abuts the base 21, and the first elastic arm 22 is restored from the deformation, such that the lower side of the blocking portion 221 abuts the stopping block 131 and the stopping block 131 limits the terminal 2 from moving downward. The second strip 6 is connected to the electrical conductor 3 and also mounted into the accommodating hole 13 upward from bottom. During mounting, the resisting portion 323 abuts the position limiting portion 132 under stress, and the resisting portion 323 is deformed to give way to the position limiting portion 132. After the resisting portion 323 passes beyond the position limiting portion 132, the resisting portion 323 is restored from the deformation, and the position limiting portion 132 is located between the resisting portion 323 and the protruding portion 322. The position limiting portion 132 abuts the protruding portion 322 to limit the electrical conductor 3 from moving upward, and abuts the resisting portion 323 to limit the electrical conductor 3 from moving downward. After mounting, the first elastic arm 22 and the first contact portions 222 expose upward from the insulating body 1. The free ends of the two first abutting portions 23 and the free ends of the two second abutting portions 25 abut the plate surface of the extending portion 32, and the second contact portions 241 downward abut the main body portion 31.

Referring to FIG. 3 and FIG. 5, when the electrical connector 10 is mounted on the circuit board 30, the main body portion 31 is soldered and fixed to the conducting sheet 301, and the second elastic arm 24 is deformed under stress, such that the two second abutting portions 25 slide upward on the extending portion 32, and the free ends of the second abutting portions 25 gradually move away from the extending portion 32. Before the circuit board 30 abuts the main body portion 31, the second abutting portion 25 and the extending portion 32 in contact with each other have a third contact position c, and before the circuit board 30 abuts the main body portion 31, and after the circuit board 30 urges the main body portion 31, the second abutting portion 25 and the extending portion 32 in contact with each other have a fourth contact position d. The third contact position c is located above the fourth contact position d, such that the second elastic arm 24 is compressed to generate a large force to abut the main body portion 31. When the mating component 20 presses the electrical connector 10, the first contact portions 222 are in contact with the pads 201 to move downward under stress, and the first elastic arm 22 is deformed, such that the first abutting portions 23 slide downward on the extending portion 32, and the free ends of the first abutting portions 23 gradually move away from the extending portion 32. Before the mating component 20 presses the first contact portions 222, the first abutting portion 23 and the extending portion 32 in contact with each other have a first contact position a before the mating component 20 presses against the first contact portions 222, and after the mating component 20 presses the first contact portions 222, the first abutting portion 23 and the extending portion 32 in contact with each other have a second contact position b. The first contact position a is located below the second contact position b. This movable elastic contact method prevents the situation that the mating component 20 crushes the terminal 2 or presses the terminal 2 to be fatigued. On the other hand, the position of the terminal 2 inevitably has tolerance or is inaccurate during machining, such that the movable contact method enables the terminal 2 to be in stable contact with the mating component 20 to avoid the phenomenon of poor contact due to excessive tolerance.

To sum up, the electrical connector 10 according to certain embodiments of the present invention has the following beneficial effects:

1. The accommodating hole 13 has the stopping portion 133 and the position limiting portion 132. The base 21 is connected to the first strip 4 downward, and the electrical conductor 3 is also connected to the second strip 6 downward, such that the terminal 2 and the electrical conductor 3 are both mounted into the accommodating hole 13 upward from bottom. The base 21 upward abuts the stopping portion 133 and thus does not excessively move upward, and the electrical conductor 3 upward abuts the position limiting portion 132 and thus does not excessively move upward, thereby ensuring that the terminal 2 and the electrical conductor 3 are accurately positioned on the circuit board 30. During soldering, the solder 5 sufficiently flows back to the soldered section of the terminal 2 and the soldered section of the electrical conductor 3 to ensure that both the terminal 2 and the electrical conductor 3 are stably soldered to the circuit board 30, thereby avoiding the phenomena of empty soldering and missing soldering.

2. When the mating component 20 is mated with the electrical connector 10, electrical signals on the mating component 20 can be conducted to the circuit board 30 through three paths. In the first path, the electrical signals are transmitted from the pads 201 to the bases 21 through the first contact portions 222, then to the second contact portions 241, and then to the main body portion 31 from the second contact portions 241, and finally to the circuit board 30. In the second path, the electrical signals are transmitted from the pads 201 to the first abutting portions 23 through the first contact portions 222, and then to the extending portion 32, and finally to the circuit board 30 from the main body portion 31. In the third path, the electrical signals transmitted to the extending portion 32 are also transmitted to the second abutting portions 25 and then transmitted to the second contact portions 241, and finally transmitted to the circuit board 30 through the main body portion 31. Compared with the single-path transmission mode, the multi-path electrical signal conduction method according to certain embodiments of the present invention increases the guarantee for the normal use of the electrical connector 10, and ensures stable transmission of the electrical signals.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body, wherein at least one accommodating hole runs through the insulating body vertically, and each of the at least one accommodating hole has a stopping portion and a position limiting portion;

wherein each of the at least one accommodating hole accommodates a terminal and an electrical conductor, and the terminal is in contact with the electrical conductor;

wherein the terminal upward abuts the stopping portion, and the terminal is configured to be connected to a first strip downward and is mounted into the accommodating hole upward;

wherein the electrical conductor upward abuts the position limiting portion, and the electrical conductor is configured to be connected to a second strip downward and is mounted into the accommodating hole upward; and wherein the accommodating hole is further provided with a stopping block, the terminal has a base accommodated in the accommodating hole, the base bends and extends to form a blocking portion, and the blocking portion upward abuts the stopping block.

2. The electrical connector according to claim 1, wherein the terminal has a first elastic arm extending upward and a second elastic arm extending downward, the first elastic arm is in contact with a mating component, at least one first abutting portion extends from the first elastic arm toward the electrical conductor, the first abutting portion is in contact with the electrical conductor, at least one second abutting portion extends from the second elastic arm to the electrical conductor, and the second abutting portion is in contact with the electrical conductor.

3. The electrical connector according to claim 2, wherein the first elastic arm has a first contact portion; before the mating component presses the first contact portion, the first abutting portion and the electrical conductor in contact with each other have a first contact position; and after the mating component presses the first contact portion, the first abutting portion and the electrical conductor in contact with each other have a second contact position.

4. The electrical connector according to claim 2, wherein the electrical conductor has a main body portion, an extending portion extends from the main body portion, the first abutting portion and the second abutting portion are in contact with the extending portion, and the main body portion is configured to be soldered to a circuit board.

5. The electrical connector according to claim 4, wherein the extending portion has a second strip connecting portion connected to the second strip, and the second strip connecting portion is located above the main body portion.

6. The electrical connector according to claim 4, wherein the second elastic arm is in contact with the main body portion; before the circuit board upward abuts the main body portion, the second abutting portion and the extending portion in contact with each other have a third contact position; and after the circuit board upward abuts the main body portion, the second abutting portion and the extending portion in contact with each other have a fourth contact position.

7. The electrical connector according to claim 2, wherein the first elastic arm has two first contact portions, a first slot is provided between the two first contact portions, the two first contact portions are both in contact with the mating component, the second elastic arm has two second contact portions, and a second slot is provided between the two second contact portions.

8. The electrical connector according to claim 7, wherein the first slot runs through a plate thickness of the first elastic arm and extends to the first abutting portion, and the second slot runs through a plate thickness of the second elastic arm and extends to the second abutting portion.

9. The electrical connector according to claim 2, wherein the terminal is provided with at least one first strip connecting portion connected to the first strip, the second elastic arm has a second contact portion, and the second contact portion is lower than the first strip connecting portion.

10. An electrical connector, comprising:

an insulating body, wherein at least one accommodating hole runs through the insulating body vertically;

wherein each of the at least one accommodating hole accommodates a terminal and an electrical conductor, and the terminal is in contact with the electrical conductor;

wherein the terminal is configured to be electrically connected to a mating component, and is configured to be connected to a first strip downward and is mounted into the accommodating hole upward; and wherein the electrical conductor is configured to be conductively connected to a circuit board, and is configured to be connected to a second strip downward and is mounted into the accommodating hole upward; and wherein the terminal has a base accommodated in the accommodating hole, a first elastic arm extends upward from the base, the first elastic arm has at least one contact portion conductively connected to the mating component, a first abutting portion extends downward from each of the at least one contact portion, a second elastic arm extends downward from the base, the second elastic arm has a second contact portion in contact with the electrical conductor, and a second abutting portion extends upward from the second contact portion; each electrical conductor has a main body portion, the main body portion is electrically connected to the circuit board, the main body portion is in contact with the second contact portion, an extending portion extends from the main body portion, and the first abutting portion and the second abutting portion are in contact with the extending portion.

11. The electrical connector according to claim 10, wherein the accommodating hole is provided with a stopping portion and a position limiting portion, the stopping portion stops the terminal downward, and the position limiting portion stops the electrical conductor downward.

12. The electrical connector according to claim 10, wherein the accommodating hole is protrudingly provided with a stopping block, the first elastic arm has a blocking portion, and the stopping block abuts the blocking portion to limit the terminal from moving downward.

13. An electrical connector, comprising:

an insulating body, wherein at least one accommodating hole runs through the insulating body vertically, and each of the at least one accommodating hole has a stopping portion and a position limiting portion;

wherein each of the at least one accommodating hole accommodates a terminal and an electrical conductor, and the terminal is in contact with the electrical conductor;

wherein the terminal upward abuts the stopping portion, and the terminal is configured to be connected to a first strip downward and is mounted into the accommodating hole upward;

wherein the electrical conductor upward abuts the position limiting portion, and the electrical conductor is configured to be connected to a second strip downward and is mounted into the accommodating hole upward; and wherein the terminal has a first elastic arm extending upward and a second elastic arm extending downward, the first elastic arm is in contact with a mating component, at least one first abutting portion extends from the first elastic arm toward the electrical conductor, the first abutting portion is in contact with the electrical conductor, at least one second abutting portion extends from the second elastic arm to the electrical conductor, and the second abutting portion is in contact with the electrical conductor.

14. The electrical connector according to claim 13, wherein the first elastic arm has a first contact portion; before the mating component presses the first contact portion, the first abutting portion and the electrical conductor in contact with each other have a first contact position; and after the mating component presses the first contact portion, the first abutting portion and the electrical conductor in contact with each other have a second contact position.

15. The electrical connector according to claim 13, wherein the electrical conductor has a main body portion, an extending portion extends from the main body portion, the first abutting portion and the second abutting portion are in contact with the extending portion, and the main body portion is configured to be soldered to a circuit board.

16. The electrical connector according to claim 15, wherein the extending portion has a second strip connecting portion connected to the second strip, and the second strip connecting portion is located above the main body portion.

17. The electrical connector according to claim 15, wherein the second elastic arm is in contact with the main body portion; before the circuit board upward abuts the main body portion, the second abutting portion and the extending portion in contact with each other have a third contact position; and after the circuit board upward abuts the main body portion, the second abutting portion and the extending portion in contact with each other have a fourth contact position.

18. The electrical connector according to claim 13, wherein the first elastic arm has two first contact portions, a first slot is provided between the two first contact portions, the two first contact portions are both in contact with the mating component, the second elastic arm has two second contact portions, and a second slot is provided between the two second contact portions.

19. The electrical connector according to claim 18, wherein the first slot runs through a plate thickness of the first elastic arm and extends to the first abutting portion, and the second slot runs through a plate thickness of the second elastic arm and extends to the second abutting portion.

20. The electrical connector according to claim 13, wherein the terminal is provided with at least one first strip connecting portion connected to the first strip, the second elastic arm has a second contact portion, and the second contact portion is lower than the first strip connecting portion.

* * * * *